US007556050B2

(12) United States Patent
Lee

(10) Patent No.: US 7,556,050 B2
(45) Date of Patent: Jul. 7, 2009

(54) SELF-DRAINAGE PREVENTING STRUCTURE OF DISH WASHER

(75) Inventor: Jhe Hyouk Lee, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 651 days.

(21) Appl. No.: 11/294,536

(22) Filed: Dec. 6, 2005

(65) Prior Publication Data

US 2006/0118142 A1 Jun. 8, 2006

(30) Foreign Application Priority Data

Dec. 7, 2004 (KR) ..... 10-2004-0102555

(51) Int. Cl.
*B08B 3/04* (2006.01)

(52) U.S. Cl. ..... 134/111; 134/186

(58) Field of Classification Search ..... 134/110, 134/111, 184, 198, 186
See application file for complete search history.

(56) References Cited

U.S. PATENT DOCUMENTS

| | | | | | |
|---|---|---|---|---|---|
| 2,924,959 | A | * | 2/1960 | Israel, Jr. | 68/18 F |
| 2,962,048 | A | * | 11/1960 | Steidley | 137/565.17 |
| 3,064,661 | A | * | 11/1962 | Jacobs | 134/58 D |
| 3,072,128 | A | * | 1/1963 | James | 134/57 D |
| 3,144,759 | A | * | 8/1964 | Bochan | 68/23.5 |
| 3,457,929 | A | * | 7/1969 | Madden | 134/95.3 |
| 3,675,448 | A | * | 7/1972 | Smith | 68/208 |
| 3,847,666 | A | * | 11/1974 | Jacobs | 134/57 D |
| 3,867,821 | A | * | 2/1975 | Hurwitz | 68/184 |
| 4,150,680 | A | * | 4/1979 | Johnson et al. | 134/104.4 |
| 4,347,861 | A | * | 9/1982 | Clearman et al. | 134/104.4 |
| 5,601,660 | A | * | 2/1997 | Jeon et al. | 134/10 |
| 5,762,080 | A | * | 6/1998 | Edwards et al. | 134/58 D |
| 6,182,674 | B1 | * | 2/2001 | Jozwiak et al. | 134/56 R |

FOREIGN PATENT DOCUMENTS

| | | | |
|---|---|---|---|
| DE | 2927097 | | 1/1980 |
| DE | 3509028 | | 9/1985 |
| DE | 69205490 | | 3/1996 |
| FR | 2 439 982 | * | 6/1980 |
| GB | 2 253 134 | * | 9/1992 |
| JP | 04-187132 | * | 7/1992 |
| JP | 11-104055 | * | 4/1999 |

OTHER PUBLICATIONS

European Patent Office 0 198 496 Oct. 1986.*
European Patent Office 0 610 876 Feb. 1994.*

* cited by examiner

*Primary Examiner*—Frankie L Stinson
(74) *Attorney, Agent, or Firm*—McKenna Long & Aldridge LLP

(57) ABSTRACT

There is provided a self-drainage preventing structure of a dishwasher. The self-drainage preventing structure includes a tub having a steam discharge hole formed at a side portion thereof, a sump assembly mounted on a bottom of the tub and having a drain pump disposed at a side thereof, and a bypass tube connected to the drain pump to allow a part of washing water introduced into the drain pump to be returned to the tub.

14 Claims, 5 Drawing Sheets

SELF-DRAINAGE PREVENTING STRUCTURE OF DISH WASHER

This application claims priority to Korean Application 10-2004-0102555 filed on Dec. 7, 2004, which is incorporated by reference, as if fully set forth herein.

BACKGROUND OF THE INVENTION

1. Field of the Invention

The present invention relates to a dishwasher and, more particularly, to a self-drainage preventing structure that can prevent, when a filter mounted in a sump is blocked by foreign objects, washing water from being self-drained to an external side through a drain pump.

2. Description of the Related Art

Generally, a dishwasher is a machine that washes and dries dishes loaded on upper and lower racks by spraying washing water pumped by the washing pump toward the upper and lower racks through spraying nozzles. The dishwasher includes a tub defining an outer appearance of the dishwasher, at least one rack disposed in the tub to load dishes, at least one spraying nozzle for spraying washing water to surfaces of the dishes, and a sump assembly mounted on a floor of the tub to reserve the washing water. Food waste adhered to the dishes are removed from the dishes by pressure applied by washing water sprayed from a spraying nozzle.

A filter is mounted in or on the top surface of the sump assembly to filter foreign objects such as food residue. The filtered foreign objects are collected in a foreign object collecting chamber formed in the sump assembly.

When the foreign objects are excessively accumulated in the foreign object collecting chamber or the washing water excessively contains foreign objects, the washing water cannot pass through the filter but stays in the drain pump connected to the foreign object collecting chamber. When the washing water is continuously accumulated in the drain pump, the drain pump cannot be operated by the pressure of the washing water. Even in this case, a part of the washing water is drained through a drain hose connected to the drain pump.

At this point, a pressure sensor or a pressure switch that is installed on a lower end of the drain hose detects this to forcedly drain the washing water.

However, when the pressure sensor or the pressure switch is installed, the manufacturing cost increases and the assembling process is complicated. Furthermore, when the pressure sensor or the pressure switch malfunctions, the self-drainage may be detected.

SUMMARY OF THE INVENTION

Accordingly, the present invention is directed to a self-drainage preventing structure of a dishwasher that substantially obviates one or more problems due to limitations and disadvantages of the related art.

An object of the present invention is to provide a self-drainage preventing structure of a dishwasher, which can prevent that can prevent, when a filter mounted in a sump is blocked by foreign objects, washing water from being self-drained to an external side through a drain pump.

Another object of the present invention is to provide a self-drainage preventing structure of a dishwasher that can allow a part of the washing water collected in a drain pump to be returned into a tub by providing a bypass structure when a circulation of the washing water is not occurred by the filter blocked by the foreign objects.

To achieve these objects and other advantages and in accordance with the purpose of the invention, as embodied and broadly described herein, there is provided a self-drainage preventing structure of a dishwasher, comprising: a tub having a steam discharge hole formed at a side portion thereof; a sump assembly mounted on a bottom of the tub and having a drain pump disposed at a side thereof; and a bypass tube connected to the drain pump to allow a part of washing water introduced into the drain pump to be returned to the tub.

In another aspect of the present invention, there is provided a self-drainage preventing structure of a dishwasher, comprising: a tub; upper and lower racks received in the tub and capable of getting in and out of the tub; a sump assembly mounted on a bottom of the tub; a drain pump provided at a side of the sump assembly; a bypass tube for connecting the drain pump to one of the tub and the sump assembly; and a foreign object collecting unit disposed in the tub.

In another aspect of the present invention, there is provided a self-drainage preventing structure of a dishwasher, comprising: a tub; a sump assembly mounted on a bottom of the tub and having a drain pump disposed at a side thereof; and a bypass tube for allowing a part of washing water introduced into the drain pump to be returned to the tub.

According to the present invention, even when the filter mounted on the sump assembly is blocked by foreign objects such as food residue, the self-drainage of the washing pump through the drain pump can be prevented.

In addition, by allowing a part of the washing water that flows to the drain pump by the filter blocked by the foreign objects, the scarceness of the washing water can be prevented during the washing process. Furthermore, the foreign objects can be collected during the washing water is returned to the tub.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
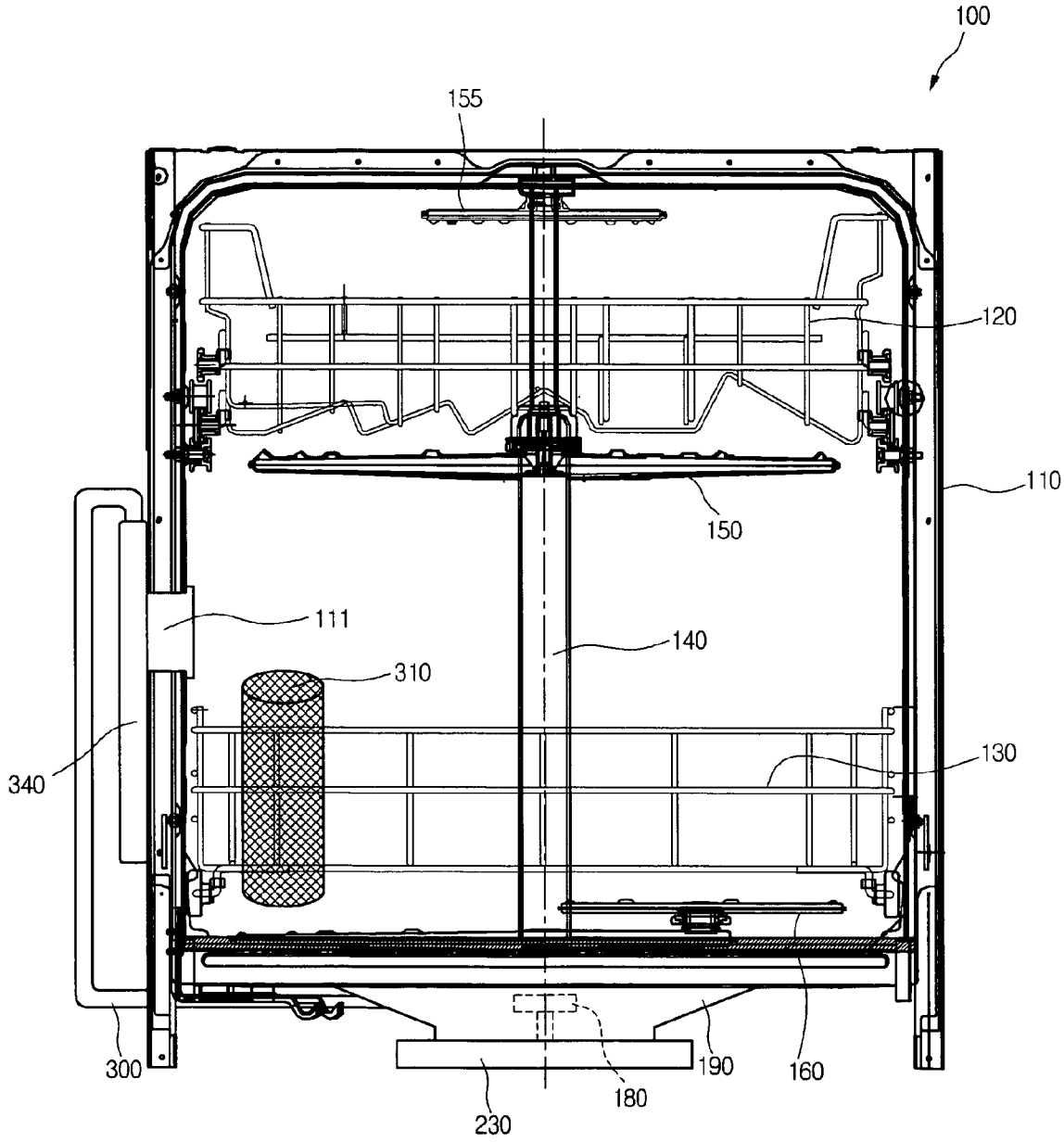
FIG. 1 is a front view of a dishwasher employing a self-drainage preventing structure according to an embodiment of the present invention.

FIG. 1 is a front view of a dishwasher employing a self-drainage preventing structure according to an embodiment of the present invention.

Referring to FIG. 1, a dishwasher 100 having a self-drainage preventing structure includes a tub 110 defining a washing chamber and a sump assembly 190 mounted on a bottom-center of the tub 110. A door is pivotally mounted on a front portion of the tub 110 to open and close the washing chamber.

The dishwasher 10 further includes a washing pump 180 provided in the sump 190 to pump out the washing water reserved in the sump assembly 190, a washing motor 230 installed on a lower portion of the washing pump 180 to drive the washing pump 180, a water guide defining a path along which the washing water pumped out by the washing pump 180, a lower nozzle 160 coupled to a top of the sump assembly 190 to spray the washing water upward and/or downward in the washing chamber, an upper nozzle 150 extending from a portion of the water guide 14 toward a center of the tub 11, and a top nozzle 155 extending from a top of the water guide 140 and located near a ceiling of the tub 110 to spray the washing water downward.

The dishwasher 100 further includes an upper rack 150 placed right above the upper nozzle 150 and a lower rack 130 disposed right above the lower nozzle 16. That is, the dishes loaded on the upper rack 120 are washed by the washing water sprayed from the upper and top nozzles 150 and 155. The dishes received on the lower rack 130 are washed by the washing water sprayed from the lower nozzle 160.

The dishwasher 100 further includes a drain pump (see 250 of FIG. 2) disposed besides the sump assembly 190, a bypass tube 300 having a first end connected to the drain pump 250, an air brake 340 to which a second end of the bypass tube 300 is connected, and a foreign object filtering basket 310 mounted on a side portion of the lower rack 130 to filter foreign objects contained in the bypassing washing water.

A part of the washing water collected in the drain pump 250 flows into the air brake 340 along the bypass tube 300. The washing water introduced into the air brake 340 is returned into the tub 110. The washing water returned to the tub 110 falls through the foreign object filtering basket 310, in the course of which the foreign objects are filtered by and collected in the foreign object filtering basket 310.

The upper rack 120 is supported by a rail (not shown) provided in an inner surface of the tub 110 so that it can reciprocally slide.

The operation of the dishwasher 100 will be now described.

The door of the dishwasher 100 is first opened and the upper rack 120 and/or lower rack 130 are withdrawn out of the dishwasher 10. The dishes are arranged on the racks 120 and 130. Then, the racks 12 and 13 are returned to their initial locations and the door is closed. When the operation button is pushed to wash the dishes received on the racks 120 and 130, a water supply valve is opened so that the washing water is supplied into the sump assembly 190. After a predetermined amount of the washing water is supplied into the sump assembly 190, the washing motor 230 operates. At this point, an impeller (refer to the reference number 2 of FIG. 2) connected to a motor shaft of the washing motor 230 and disposed in the washing pump 180 rotates to pump the washing water to the lower nozzle 160 and the water guide 140.

The washing water pumped out to the water guide 140 is sprayed into the washing chamber via the top and upper nozzles 155 and 150. By the washing water sprayed from the nozzles, the dishes loaded on the racks 120 and 130 are washed.

The washing water sprayed downward from the top nozzle 155 and the washing water sprayed upward from the upper nozzle 150 wash the dishes loaded on the upper rack 120.

The washing water sprayed upward from the lower nozzle 160 washes the dishes loaded on the lower rack 130. By forming spraying holes on a bottom of the upper nozzle 150, the upper nozzle 150 may spray the washing water upward and downward to simultaneously wash both surfaces of the dishes.

The foreign objects generated during the washing process are filtered by a filter (not shown) provided in the sump assembly 190 and ground to small particles by a disposer (not shown) mounted in the sump assembly 190. When the washing process is finished, the used washing water is drained together with the foreign objects out of the dishwasher 100 through a drain pump (not shown).

When the used washing water is drained, clean rinsing water is supplied to the sump assembly 190 through a washing water inlet and sprayed through the nozzles 150, 160 and 155 to perform a rinsing process. When the rinsing process is finished, a drying process is performed to finalize the whole washing process.

Meanwhile, when the washing water dropt to the floor of the tub is returned into the sump assembly. Most of the washing water pumped out by the washing pump 190 flows to the water guide 140 or the lower nozzle 160 and a small amount of the washing water passes through the turbidity sensor so the turbidity level of the washing water can be detected. The washing water passing through the turbidity sensor flows to the drain pump 250. When the drain pump 250 is fully filled with the washing water in a state where the drain pump 250 does not operate, the washing water flows backward into the foreign object collecting chamber formed in the sump assembly 190. When the foreign object collecting chamber is fully filled with the washing water, the washing water flows backward to the floor of the tub via the self-cleaning filter assembly formed on the upper end of the foreign object collecting chamber.

Here, when the self-cleaning filter assembly is blocked by the foreign objects, the water pressure of the washing water directed to the foreign object collecting chamber. At the same time, internal pressure of the drain pump 250 increases. In this case, in a state where the drain pump does not operate, a part of the washing water collected in the drain pump 250 flows along the bypass tube 300 and then to the air brake 340. Then, the washing water is returned into the tub 110 through a steam discharge hole 111 connecting the tub 110 to the air brake 340. The washing water returned into the tub 110 falls to the foreign object collecting basket 310 mounted on the lower rack 130, in the course of which the foreign objects contained in the washing water are filtered by and remained in the foreign object collecting basket 310.

Figure 2:
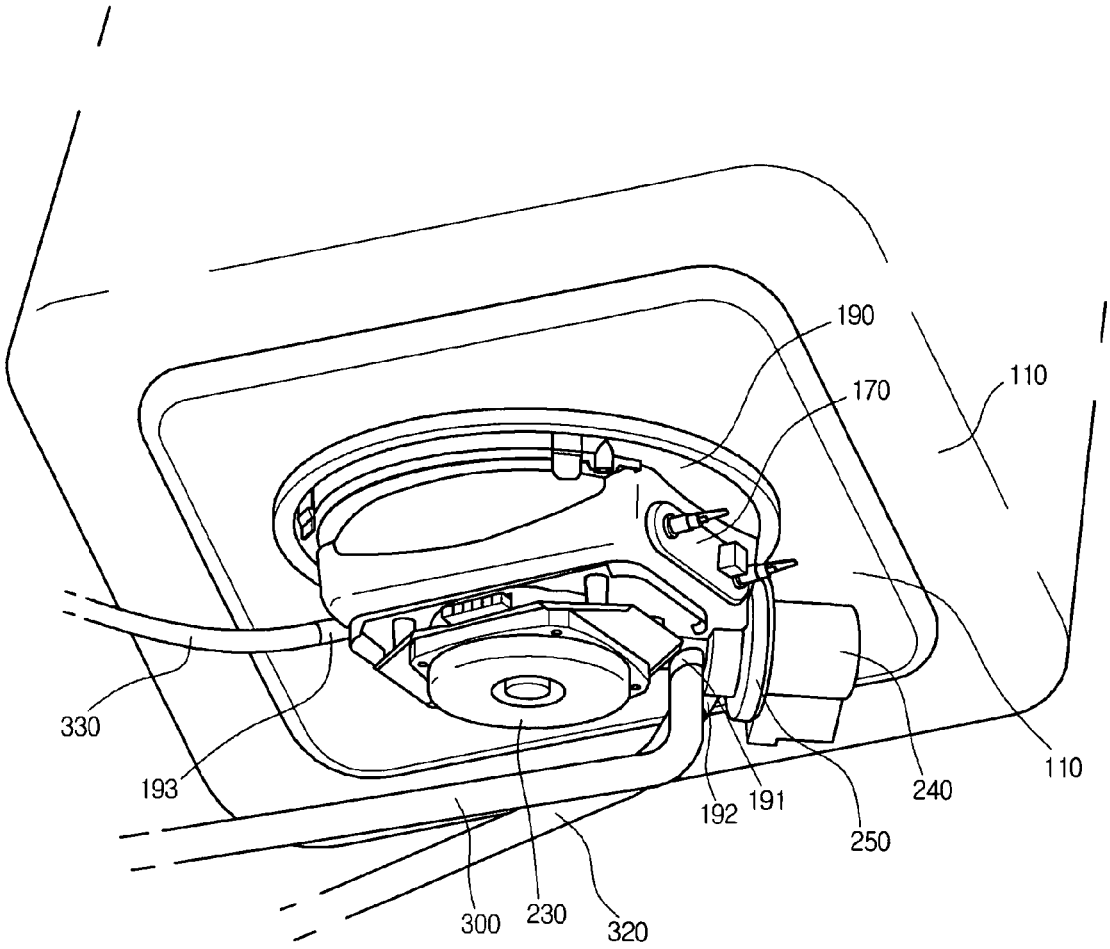
FIG. 2 is a rear perspective view of a sump assembly depicted in FIG. 1.
Figure 3:
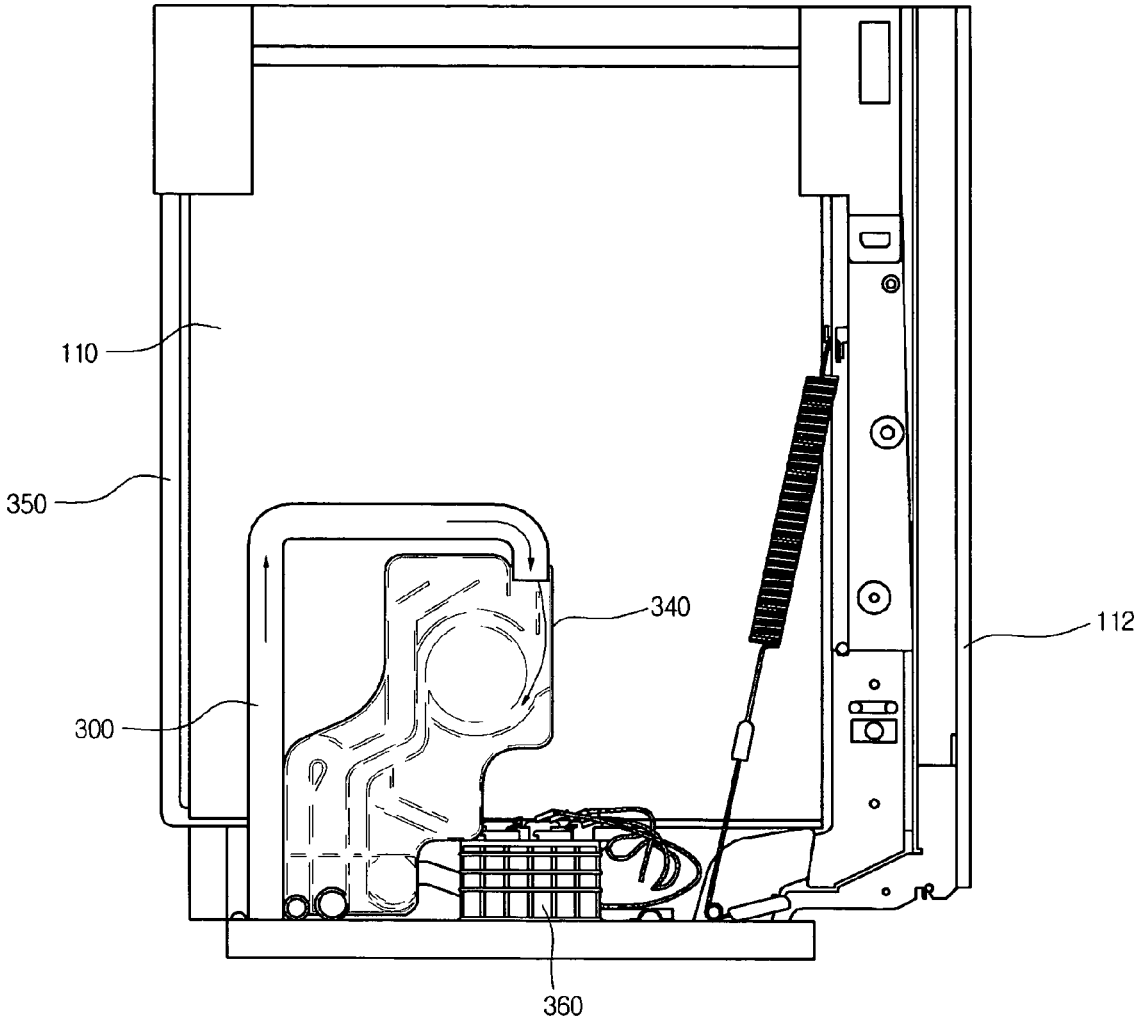
FIG. 3 is a side view of FIG. 1.

FIG. 2 is a rear perspective view of the sump assembly depicted in FIG. 1 and FIG. 3 is a side view of FIG. 1.

Referring to FIGS. 2 and 3, the self-drainage preventing structure of the present invention is formed in connection with the sump assembly 190 mounted on the bottom of the dishwasher 100.

The sump assembly 190 includes a washing motor 230 for driving the washing pump 180, a drain pump for draining the washing water to an external side, a drain motor 240 for driving the drain pump 250, and a bypass connecting portion 191 extending from the drain pump 250. A bypass tube 300 is connected to the bypass connecting portion 191 to return the washing water directed to the drain pump 250 into the tub 110.

That is, the bypass tube 300 has a first end connected to the bypass connecting portion 191 and a second end connected to the air brake 340. Therefore, the washing water flowing along the bypass connecting portion 191 flows to the air brake 340.

A drain tube 320 is connected to a side portion of the drain pump 250 to allow the washing water to flow to the air brake 340 during the drain process. A water supply tube 330 is connected to a side portion of the sump assembly 190 to allow the washing water supplied from the water source to flow into the sump assembly 190.

The air brake 340 is mounted on a side portion of the tub 110 and the washing water supplied from the water source passes through the air brake 340. That is, the air brake 340 functions as a path through which the washing water flowing along the drain tube 320 and the bypass tube 300 passes. A floater 360 is connected to a side portion of the air brake 340 to detect a water level of the tub 110. The constitution and function of the air brake 340 will be described later with reference to the accompanying drawings.

Meanwhile, the second end of the bypass tube 300 is connected to an upper opening of the air brake 340. Therefore, the washing water flowing along the bypass tube 300 is returned into the tub 110 via the air brake 340. The washing water in the drain tube 320 which is connected to the air brake 340 flows along a drain passage formed in the air brake 340. A drain hose 350 is connected to an end of the drain passage so that the washing water flowing along the drain passage can be drained to the external side. The washing water directed into the tub via the bypass tube 300 and the air brake 340 falls to the foreign object collecting basket 310.

Alternatively, the second end of the bypass tube 300 may be directly connected to a side portion or bottom of the tub 110 without being connected to the air brake 340. In addition, the foreign object collecting basket 310 is mounted at a location where the bypass tub 300 penetrates the tub 110 so that the foreign objects can be filtered by the foreign object collecting basket 310.

Alternatively, the second end of the bypass tube 300 may be connected to a side portion of the sump assembly 190. In the sump assembly 190, the heater is mounted and the washing water reserving chamber is formed. The washing water serving chamber and the drain pump 250 are divided from each other by a check valve. That is, in the drain process, the check valve is opened so that the washing water reserved in the washing water reserving chamber flows to the drain pump 250. However, in other processes except for the drain process, the washing water collected in the drain pump 250 cannot flow to the washing water reserving chamber by the check valve.

Therefore, when the first and second ends of the bypass tube 300 are respectively connected to the drain pump 250 and the washing water reserving chamber, a part of the washing water reserved in the drain pump 250 can flow to the washing water reserving chamber during the washing and rinsing processes.

Figure 4:
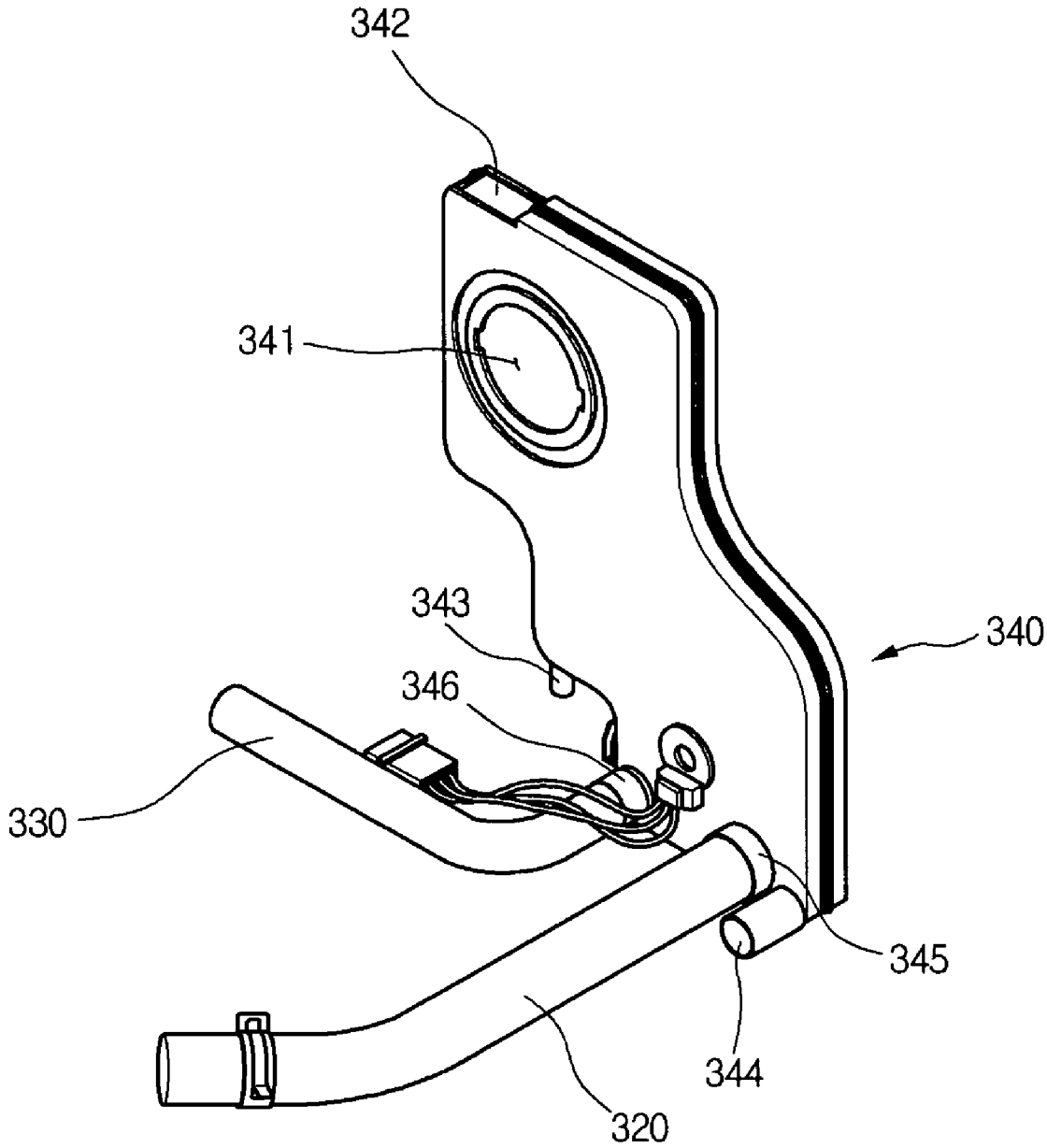
FIG. 4 is a perspective view of an air brake depicted in FIG. 3.

FIG. 4 is a perspective view of the air brake depicted in FIG. 3.

Referring to FIG. 4, the air brake 340 is connected to a side portion of the tub 110.

The air brake 340 includes an air hole 341 communicating with the steam discharge hole 111 formed on the side portion of the tub 110, a bypass tube insertion hole 342 in which the bypass tube 300 is inserted, a drain hose connecting hole 344 connected to the drain hose 350, and a drain tube connecting hole 345 formed away from the drain hose connecting hole 344 and connected to the drain tube 320. A drain passage connecting the drain hose connecting hole 344 to the drain tube connecting hole 345 is formed in the air brake 340.

The air brake 340 further includes a water supply tube connecting hole 346 formed away from the drain tube connecting hole 345 and a floater connecting hole 343 connected to the floater 360.

The washing water is introduced into the air brake 340 through the water supply tube 330 connected to the water supply tube connecting hole 346. The washing water introduced into the air brake 340 is directed to the floater through the floater connecting hole 343 and is then returned into the tub 110.

The washing water, which flows to the drain pump 250 by the filter blocked during the washing process, flows along the bypass tube 300. Then, the washing water is introduced into the air brake through the bypass tube insertion hole 342. The washing water introduced into the air brake 340 is returned to the tub 110 via the air hole 341 and the steam discharge hole 111.

When the drain process starts, the washing water pumped out by the drain pump 250 flows into the air brake 340 along the drain tub 320. The washing water introduced into the air brake 340 is drained to the external side through the drain tube connecting hole 345 and the drain hose 350 while flowing along the drain passage formed in the air brake 340.

Preferably, an additional steam discharge hole (not shown) may be formed on the air brake 340 at a portion spaced apart from the bypass tube insertion hole 342 of the air brake 340. That is, a part of the steam generated during the high-temperature washing process is introduced into the air brake 340 through the air hole 341 and is then discharged through the steam discharge hole. Therefore, the excessive increase in the internal pressure of the tub 110 by the steam generated during the high-temperature washing process can be avoided.

In addition, a barrier is properly formed in the air brake 340 so that the washing water introduced into the air brake 340 through the bypass tube 300 can be fully introduced into the tub 110 through the air hole 341. The barrier prevents the washing water containing the foreign objects from being introduced toward the floater 360.

Figure 5:
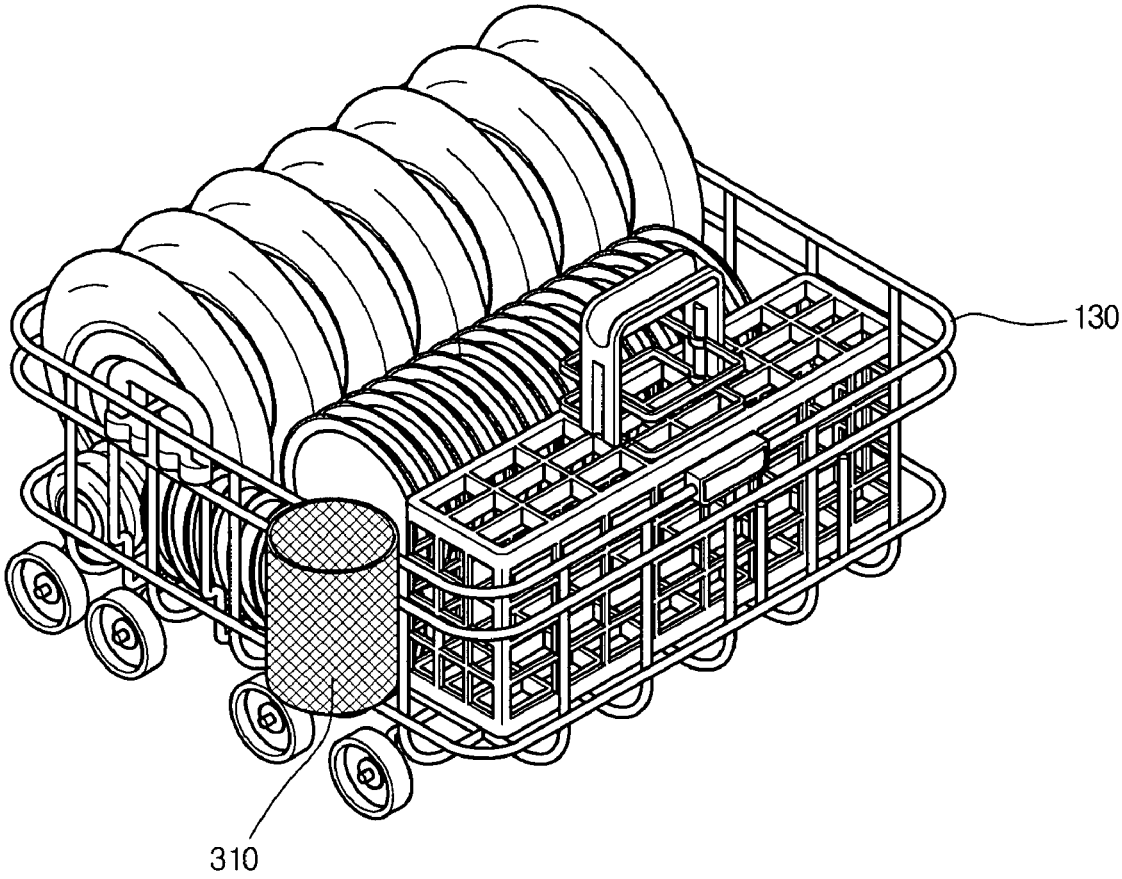
FIG. 5 is a perspective view of an assembly of the lower rack and the foreign object collecting basket that are depicted in FIG. 1.

FIG. 5 is a perspective view of an assembly of the lower rack and the foreign object collecting basket that are depicted in FIG. 1.

Referring to FIG. 5, the foreign object collecting basket 310 is mounted on the side portion of the lower rack 130.

The foreign object collecting basket 310 is installed at a location to which the washing water falls through the steam discharge hole 111. That is, by allowing the washing water introduced through the steam discharge hole 111 to fully fall to the foreign object collecting basket 310, the foreign objects contained in the washing water are not accumulated on the floor of the tub.

The side portion of the lower rack 130, on which the foreign object collecting container 310 is mounted, is preferably depressed inward so as to prevent the interference between the foreign object collecting basket 310 and the inner circumference of the tub 110 during the lower rack 130 gets into and out of the tub 110.

Alternatively, the foreign object collecting basket 310 may be disposed inside the lower rack 130.

Alternatively, the foreign object collecting basket 310 may be mounted right under the steam discharge hole 11 on the inner circumference of the tub 110. That is, the foreign object collecting basket 310 is designed to have a width by which no interference between the foreign object collecting basket 310 and the rack is occurred. In addition, the foreign object collecting basket 310 is mounted to closely contact the inner circumference of the tub 110. Since the foreign object collecting basket is disposed right under the seam discharge hole 111, the washing water introduced through the steam discharge hole 11 is fully directed toward the foreign object collecting basket 310. While the washing water passes through the foreign object collecting basket 310, the foreign objects contained in the washing water are filtered by and collected in the foreign object collecting basket 310. Then, the washing water whose foreign objects are filtered falls to the floor of the tub 110 and flows to into the sump assembly 190.

Here, in order to prevent the interference between the foreign object collecting basket 310 and the lower rack received in the tub 110, the width of the foreign object collecting basket 310 may be reduced or the foreign object collecting basket 310 may be disposed between a space defined between the upper and lower racks 120 and 130.

In addition, the foreign object collecting basket 310 may be detachably mounted on the steam discharge hole 111. That is, a member such as a lint filter that is installed on an inner circumference of a washing tube in a pulsator type washing machine may be coupled to the steam discharge hole 111.

It will be apparent to those skilled in the art that various modifications and variations can be made in the present invention. Thus, it is intended that the present invention covers the modifications and variations of this invention provided they come within the scope of the appended claims and their equivalents.

What is claimed is

1. A self-drainage preventing structure of a dishwasher, comprising:

a tub having a steam discharge hole formed at a side portion thereof;

a sump assembly mounted on a bottom of the tub and having a drain pump disposed at a side thereof;

a bypass tube of which one end is extended from a proximal portion of an inlet of the drain pump to allow a part of washing water introduced into the drain pump to be returned to the tub;

an air break mounted on a side portion of the tub and communicating with the steam discharge hole, wherein the other end of the bypass tube is connected to the air break.

2. The self-drainage preventing structure according to claim 1, further comprising a bypass connecting portion which is formed at the proximal portion of the inlet of the drain pump and to which one end of the bypass tube is connected.

3. The self-drainage preventing structure according to claim 1, wherein the washing water flowing along the bypass tube is fully introduced into the tub via the air break.

4. The self-drainage preventing structure according to claim 1, wherein the air break is provided at a side portion with a first air hole communicating with the steam discharge hole and the washing water discharged from the bypass tube is introduced into the tub through the holes.

5. The self-drainage preventing structure according to claim 1, wherein the air break includes a bypass connecting hole to which the bypass tube is connected and a second air hole for discharging steam discharged through the steam discharge hole of the tub to an external side.

6. The self-drainage preventing structure according to claim 1, further comprising a foreign object collecting unit disposed in the tub to filter foreign objects contained in the washing water discharged from the bypass tube and falling into the tub.

7. The self-drainage preventing structure according to claim 6, wherein the foreign object collecting unit is mounted on inner or outer surfaces of a dish rack.

8. The self-drainage preventing structure according to claim 6, wherein the foreign object collection unit is closely coupled to an inner circumference of the tub at a location right under the steam discharge hole.

9. The self-drainage preventing structure according to claim 6, wherein the foreign object collecting unit is detachably mounted on the tub or a side portion of a dish rack.

10. The self-drainage preventing structure according to claim 1, wherein the foreign object collecting unit is coupled to the steam discharge hole of the tub.

11. A self-drainage preventing structure of a dishwasher, comprising:

a tub;

upper and lower racks received in the tub and capable of getting in and out of the tub;

a sump assembly mounted on a bottom of the tub;

a drain pump provided at a side of the sump assembly;

a bypass tube for connecting an inlet portion of the drain pump to the tub; and a foreign object collecting unit disposed in the tub, wherein the bypass tube has a first end connected to the drain pump and a second end directly connected to the tub.

12. The self-drainage preventing structure according to claim 11, wherein the foreign object collecting unit is mounted on a portion of an inner circumference of the tub, through which the bypass tube penetrates.

13. The self-drainage preventing structure according to claim 11, wherein the foreign object collecting unit is installed on the inner circumference of tub between the upper and lower racks.

14. A self-drainage preventing structure of a dishwasher, comprising:

a tub;

upper and lower racks received in the tub and capable of getting in and out of the tub;

a sump assembly mounted on a bottom of the tub;

a drain pump provided at a side of the sump assembly;

a bypass tube for connecting an inlet portion of the drain pump to the sump; and a foreign object collecting unit disposed in the tub, wherein the bypass tube has a first end connected to the drain pump and a second end connected to a side portion of the sump assembly.

* * * * *